United States Patent [19]

Kotler

[11] Patent Number: 4,930,286

[45] Date of Patent: Jun. 5, 1990

[54] MODULAR SPORTS TILE WITH LATERAL ABSORPTION

[76] Inventor: Daniel Kotler, 6233 Canyon Cove Cir., Salt Lake City, Utah 84121

[21] Appl. No.: 307,272

[22] Filed: Feb. 6, 1989

Related U.S. Application Data

[63] Continuation-in-part of Ser. No. 167,708, Mar. 14, 1988, Pat. No. 4,860,510.

[51] Int. Cl.[5] ..... E01C 5/20; E04F 15/02

[52] U.S. Cl. ..... 52/177; 52/602; 404/41; 428/33; 428/44

[58] Field of Search ..... 52/177, 602; 273/3; 404/41, 33, 44, 45, 52, 131, 41; 428/33

[56] References Cited

U.S. PATENT DOCUMENTS

| | | | |
|---|---|---|---|
| 3,699,926 | 10/1972 | Stocki | 52/177 |
| 4,054,987 | 10/1977 | Forlenza | 272/3 |
| 4,287,693 | 9/1981 | Collette | 52/177 |
| 4,436,779 | 3/1984 | Menconi | 428/169 |
| 4,478,901 | 10/1984 | Dickens | 428/120 |

*Primary Examiner*—James L. Ridgill, Jr.

[57] ABSTRACT

A modular tile for interlocking with other similar tiles to form a floor covering which provides enhanced traction at its playing surface and improved tolerance to sudden lateral movement. The tile comprises a plastic support grid having rectangular configuration bounded by a perimeter wall and including a repeating pattern of intersecting cross members with interstitial openings formed inbetween. A plurality of support legs are coupled to a base side of the cross junctions in general perpendicular orientation. Interlock structure is coupled to and extends outward from the perimeter wall to enable removable attachment with other modular tiles of similar design. The interlock structure provides a continuous, uniform displacement gap between adjacent perimeter walls which establishes a separation distance between the range of 0.5 to 2 millimeters, and also provides a yielding response to absorb lateral forces. A continuous sheet of plastic provides a flat surface cap to the tile, which enables its use as part of a continuous flat athletic floor covering.

7 Claims, 2 Drawing Sheets

MODULAR SPORTS TILE WITH LATERAL ABSORPTION

This is a continuation-in-part application of Ser. No. 07/167,708 filed Mar. 14, 1988.

BACKGROUND OF THE INVENTION

1. Field of the Invention:

This invention relates to plastic tiles which are supported above a floor surface to provide a playing surface for sports such as basketball, tennis, and the like. More particularly, the present invention pertains to modular tiles of plastic composition which are interlocked to form a playing surface where sudden lateral forces are imposed during use, requiring both traction and safety.

2. Prior Art:

A wide variety of floor coverings have been developed for use as playing surfaces for athletic activities. For example, hardwood floors have long been recognized as beneficial for rebound properties and comfort, but difficult to maintain and expensive to construct. Playing floors have also been constructed of tiles cemented to a cement subsurface; however, such flooring is very unforgiving to a fallen athlete, and offers minimal safety benefits. Both wood and fixed tile or cement floors share a similar disadvantage in that they are not capable of absorbing lateral impact forces so common to sport activities which involve jumping, running and sudden changes in direction of movement.

Modular flooring has grown in popularity because of its versatility, but has nevertheless failed to meet all desirable criteria of athletic floors. Structurally, the modular tile is fabricated of plastic material and usually adopts a grid configuration wherein the tile surface is a cross pattern of grid surfaces with closely spaced support legs extending down from grid crossings. A variety of grid patterns has developed, providing unusual aesthetic appearance as well as functional response.

The present inventor has developed a number of different modular tile members incorporating special leg support structure, as well as surface variations. The following U.S. Patent is representative of the inventor's prior work: U.S. Pat. No. Des. 274,588. Other inventors have similarly adopted the conventional approach for modular tile member wherein a grid system is used as the playing surface. These are represented by J. P. M. Becker, et al U.S. Pat. No. 3,438,312; Ralph Ettlinger, Jr. U.S. Pat. No. 3,909,996; K. Anthony Menconi, U.S. Pat. No. 4,436,799; Raymond W. Leclerc, U.S. Pat. No. 4,008,548; Esko Nissinen, U.S. Pat. No. 4,167,599; Hans Kraayenhof, U.S. Pat. No. 4,226,064; and Chester E. Dekko, U.S. Pat. No. Des. 255,744.

It is noteworthy that none of the athletic playing floors utilizing modular plastic members has adopted a continuous flat surface, despite the inherent advantage of comfort as demonstrated by traditional hardwood floors. Instead, the grid configuration is used, leading to special design problems for enhancing traction and reducing risk of injury due to falls and other forms of contact at the floor surface. Indeed, the dozens of differing designs occurring in the prior art are in most cases the result of attempts to adapt the grid system with one or more advantages of the flat surface more traditionally used in sport flooring.

A major reason for avoidance of the preferable flat, continuous surface arises from the difficulty of fabricating and maintaining plastic tiles which will rest flush on the supporting floor surface without adhesive, despite changes in temperature and effects of extended use. U.S. Pat. No. 4,436,799 by Menconi et al discusses several of the more important limitations that dictated in favor of fabrication of grid systems. For example, maintaining the support legs in contact with the support surface is critical, but has been a problem. Temperature variations may cause the tile to buckle, lifting corners or edges and creating a safety hazard as well as limiting the effective use of the tile floor as a ball-contacting surface. Id. Col 1, lines 30–37.

Prior art techniques for dealing with this limitation have included use of expansion joints and crossing reinforcement members or stiffeners. Stretch installation techniques have been applied and refinement of compositions to reduce thermal coefficients of expansion have also been attempted. The historical difficulty of dealing with such problems for grid configurations further reinforces the fact that modular tiles having a continuous flat surface are of even greater likelihood to buckle and distort. A continuous surface of plastic has a much greater tendency to twist and buckle as the polymer experiences temperature variations. Consequently, the prior art is virtually barren of plastic tiles for athletic flooring which have a continuous, flat surface and are modular and interlocking in a recurring manner.

OBJECTS AND SUMMARY OF THE INVENTION

It is therefore an object of the present invention to provide floor surfacing members which may be interlocked together to form a modular floor covering and which are capable of remaining flat without adhesive attachment to the sub-floor surface.

It is a further object of the present invention to provide a floor covering tile which absorbs lateral forces to reduce resistance imposed upon the feet and ankles of a player.

It is a still further object of this invention to provide a modular tile which provides a flat, continuous surface offering maximum fraction, which does not buckle or deform when positioned on the floor, despite temperature changes.

These and other objects are realized in a modular tile for interlocking with other similar tiles as part of a floor covering for use in athletic arenas, courts and similar places where injury might be reduced by improved tolerance to sudden lateral movements of the players. The present tile comprises a plastic support grid having a rectangular configuration bounded by a perimeter wall on four sides and including a repeating pattern of intercepting cross members of similar corresponding dimensions. These cross members are integrally formed as part of the support grid and extend inward from the perimeter wall, joining across junctions along a common plane and forming interstitial openings therebetween. Support legs are integrally attached to a base side of the cross junctions in general perpendicular orientation with respect to this support grid and have common lengths in order to provide a single plane of contact at the supporting floor. Interlock means are coupled to and extend outward from the perimeter wall to enable removable attachment of additional modular tiles of similar design at corresponding edges thereof. The interlock means position the attached tiles in slightly separated configuration to provide a continuous, uniform displacement gap between adjacent perimeter walls. In static conditions, this gap develops a separation distance within the range of 0.5 to 2.0 millimeters and is established by biased position on the interlocking means which yields in response to lateral forces imposed at the tile along a perpendicular orientation with respect to the attached perimeter wall to collapse or extend the gap and thereby absorb the lateral forces. The interlock means provides resiliency or a restoration force to return to the biased position and desired gap range. A continuous sheet of plastic is integrally formed in uniform thickness with the top edge of the support grid to provide a flat surface cap bounded at its edges by the perimeter walls of the tile.

Other objects and features will be apparent to those skilled in the art, based on the following detailed description, taken in combination with the accompanying drawings.

DETAILED DESCRIPTION OF THE INVENTION

Figure 1:
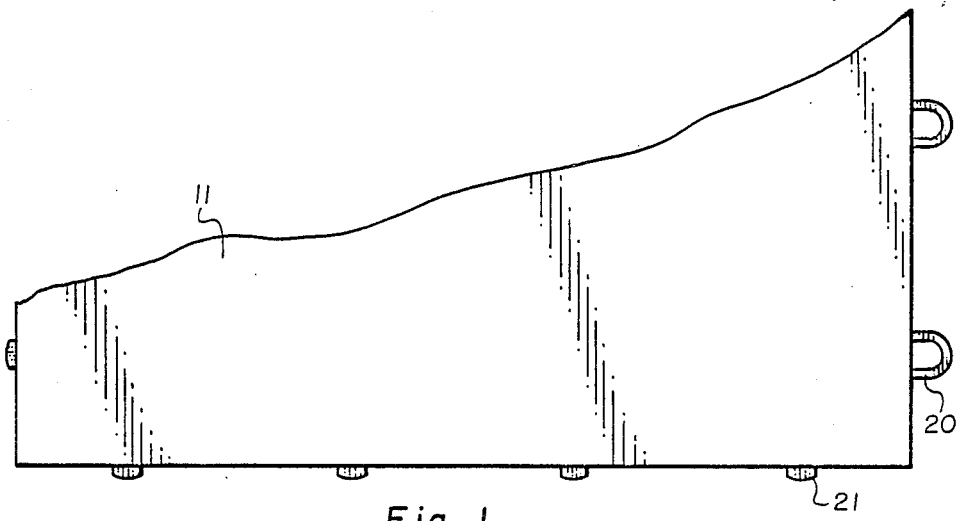
FIG. 1 shows a top plan view of a segment of a square tile constructed in accordance with the present invention.

Referring now to the drawings:

FIG. 1 discloses a modular, plastic tile 10 suitable for application as part of floor covering for a tennis court, basketball court or other athletic area. The inventor has discovered that such modular plastic tiles can be adapted with a continuous, flat surface 11 by unique combination of features disclosed herein which prevent the traditional buckling and deformation of the tile responsive to temperature changes which heretofore mandated the grid-like construction of prior art tile members. The flat surface 11 offers a much improved traction area needed for athletic events, and facilitates the athlete's need to change directions, start, stop and make other quick movements associated with athletic activities. These tiles are respectively interconnected to form a continuous flat surface suitable for such sporting events.

Figure 3:
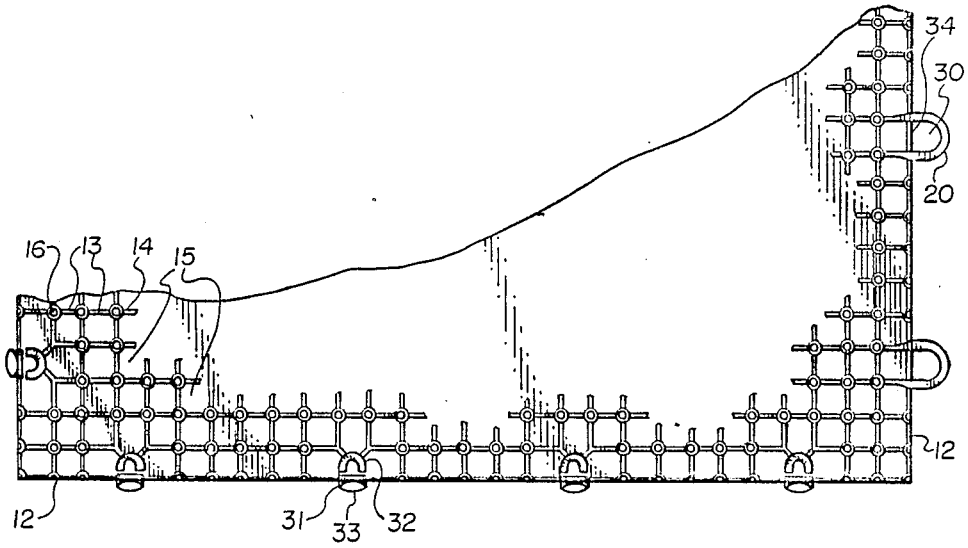
FIG. 3 illustrates a bottom, plan view of the title of FIG. 1, with a central portion of the leg support and grid structure eliminated to expose a bottom surface of the surface cap.

The flat surface 11 is supported by plastic support grid which is best viewed in FIG. 3. This floor grid forms a rectangular configuration bounded by a perimeter wall 12 on each of the four sides and including a repeated pattern of intersecting cross members 13 of common corresponding height and width dimensions. These cross members are integrally formed and extend inwardly from the perimeter wall 12, joining at cross junctions 14. A plurality of interstitial openings 15 are thereby formed between the respective cross members 13. A plurality of support legs 16 of common length are integrally formed and coupled to a base side of the cross junctions 14 in general perpendicular orientation with respect to the support grid.

When isolated from the top, flat portion of the tile, this support grid appears to be an array of support legs interlinked by cross members which maintain the support legs within a common plane for contact at a base end 17 of the leg structure and at an upper side of the cross members to which the top cover 11 is integrally formed. This support grid and leg assembly is uniform in composition and geometry across its repeating pattern to minimize expansion effects of temperature and use.

Figure 4:
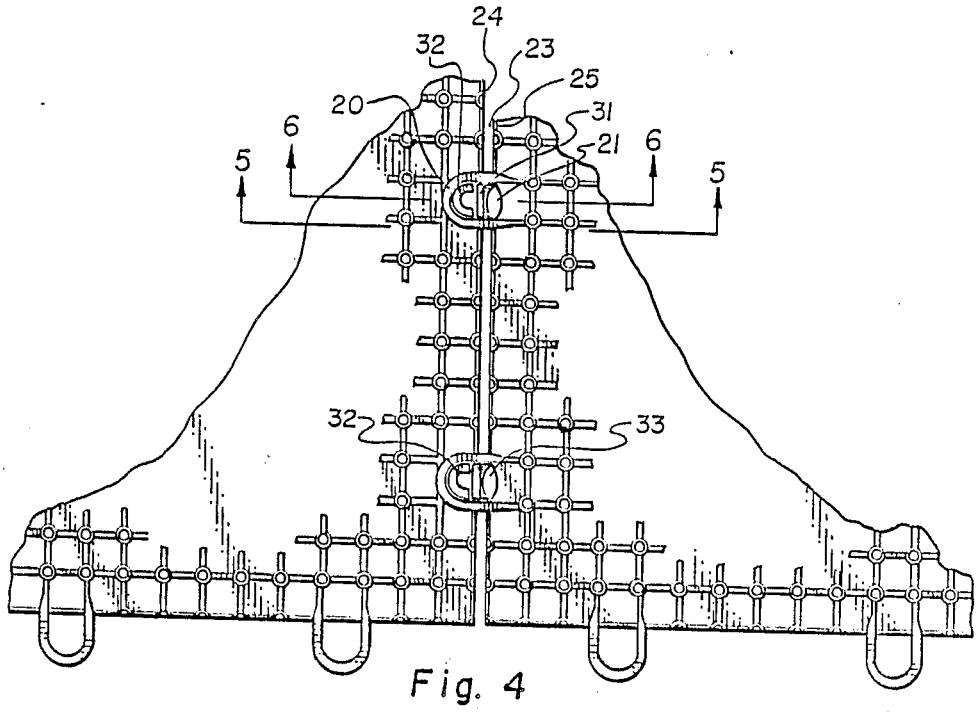
FIG. 4 shows a bottom, plan view of two tiles interlocked as part of an assembled array of tiles.

This plastic support grid also includes interlock means 20 and 21 which are coupled to and extend outward from the perimeter wall 12 to enable removable attachment of additional modular tiles of similar design at corresponding edges. The function of the interconnect means is not only to couple adjacent tiles, but also to establish a proper displacement between perimeter walls 12 of each tile. This is accomplished by establishing a continuous, uniform displacement gap 23 between adjacent perimeter walls 24 and 25 (FIG. 4). The separation distance for this gap may range from 0.5 millimeters to 2.0 millimeters, but it is generally preferable at approximately 1 millimeter. This separation distance is based on tiles of approximately one foot square dimension and may vary somewhat for tiles of differing sizes.

Figure 5:
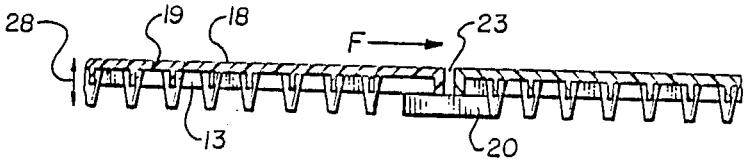
FIG. 5 shows an enlarged cross sectional view taken along the lines 5—5 of FIG. 4.

This desired separation distance is accomplished by configuring the interlock means 20 and 21 such that a biased position is developed which orients the respective tiles at the prescribed separation distance, but yields in response to lateral forces imposed at the tile along a perpendicular orientation with respect to the perimeter walls 24 and 25. In other words, a biased position is provided which is assumed by the tiles and interlock means in the absence of lateral forces. This biased position is shown in FIGS. 4 and 5. This is also referred to as the static mode or condition, as contrasted with a dynamic mode if the tile is subjected to a lateral force F (FIG. 5). Depending on the strength of the lateral force, the gap 23 may collapse (or extend if the force is applied in the opposite direction) to thereby absorb such lateral forces. When force is relieved, the interlock means 20 and 21 return to the biased position within the desired gap range.

Figure 2:
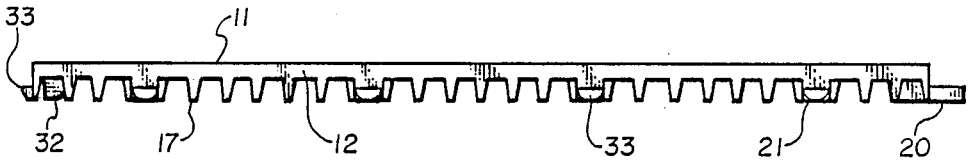
FIG. 2 shows a side, plan view of the tile illustrated in FIG. 1 taken from the edge along the bottom of the drawing.

The operation and components of the interlock means 20 and 21 is more clearly illustrated in FIG. 4. In the preferred embodiment, the interlock means includes a projecting loop 20 which is integrally formed with the support grid and defines a loop opening 30 for receiving the insert member 21. The dimension of this opening 30 is designed for a moderately snug fit for the corresponding insert member 21, thereby allowing a range of movement. As can be seen in FIGS. 2 and 3, this insert member includes two components, a spring-biased clip 31 and stabilizing member 32. The spring-biased clip 31 has a projecting flange 33 which operates as the retaining element to hold the two tiles in coupled relationship with the flange abutting under side 12 of the adjacent tile. The stabilizing member 32 nests within the arcuate section of the opening 30, and the spring-biased element 33 seats against the perimeter wall within the loop 34.

This interlock configuration is more clearly illustrated in FIG. 4. This figure shows the stabilizing member 32 at the left side of the loop, operating to establish one side the separation range or distance for the biasing position and desired gap 23. The spring-biasing member 33 functions to extend the tiles by pushing the tile to which the loop 20 is coupled until the interior opening of the loop abuts against the stabilizing member 32. In other words, the two tiles are spring-biased to a separated distance 23, but may be collapsed together in response to lateral forces which overcome the spring-biasing forces 33.

The interlock means 20 and 21 also enable some extension of gap 23 when a pulling force is applied (opposite to the force shown in FIG. 5). In this instance, the loop section of member 20 elongates slightly against the resistance of the stabilizing member 32. Upon release of the force, the resilience of the loop element 20 pulls the stabilizing member 32 back to the biased position, with the original static separation gap 23.

In summary, the interlock means provides a spring-biased interconnect which operates in three different modes. In the biased position or static mode, separation distance 23 is defined by the static geometry of the loop member 20 as it seats around the stabilizing member 32 and spring-biased member 33. In the second mode, compression forces push one tile toward a second tile, collapsing the separation gap 23. Static tile separation distance resumes upon termination of the force, with the biasing member 33 extending and pushing the tiles to their static configuration. Finally, the third mode occurs where the force is applied away from the gap 23, elongating loop member as it pulls against the stabilizing member 32. Upon dissipation of the force, the resilient memory of the loop pulls the extended tile to its original, static position.

To complete the tile structure, a continuous sheet of plastic 18 is integrally formed in uniform thickness with the top edge 19 of the support grid. This top sheet operates as a flat surface cap which is bonded at its edges to the perimeter walls 12 of the tile. Accordingly, the top and side view of the tile represented by FIGS. 1 and 2 show a flat surface 11, with flat perimeter wall structure 12 (FIG. 2). Within this exterior enclosure, is the support grid as is illustrated in FIG. 3. The thickness of the surface cap should be at least 1.5 millimeters, and is preferably 2 to 2.5 millimeters in thickness. This is based on a total height 28 of 12 millimeters. Here again, these dimensions may be subject to variation, depending upon tile sizes.

These dimensions provide sufficient stiffness within the surface cap, supported by the grid structure to provide adequate control of thermal expansion and other factors which have traditionally caused supported plastic tile flooring to deform or fail to properly perform. This, in combination with the bias separation distance 23 between the respective tiles operates to establish a uniform response which enables the use of a continuous, flat tile surface as part of a raised, grid tile structure.

The final element assisting in maintaining the desired flat configuration is accomplished during the fabrication stage. Specifically, this aspect of the invention relates to a method for preparing the tile by conventional molding techniques such as injection molding wherein liquid polymer is cured at high temperatures within the mold. Upon releasing the tile from the mold at the elevated temperature, the direction and extent of buckling which occurs as the tile cools is carefully observed. If the tile buckles upward at any of its respective corners, the extent of deflection is noted. As subsequent tiles are processed, upon being released from the mold, these same tile corners are deflected in the opposing direction from their natural buckling movement to an extent wherein the polymer structure is stressed and results in displacement during cooling to a flat configuration. This stressing action is applied to each sequential tile removed from the mold, whereupon the tiles are weighted during a prescribed cooling period.

The degree of flexing or deflection is somewhat intuitive, based on experience of the fabrication personnel with the particular polymer and tile in question. The object to counter the cooling deflection stress by prestressing the polymer in opposing directions, and then applying weights over each tile to prevent buckling during cooling.

Accordingly, the present invention discloses that flat-surfaced tile structure is feasible where the tile is preliminarily stressed to overcome natural buckling and distortion which arises during cooling of the tile following polymer cure This prestressed tile is capable of maintaining the desired flat configuration by virtue of the configuration of each tile member, including the interconnecting structure which establishes the desired separation distance between each respective tile. An additional advantage of this structure is the benefit to athletes which experience cushioned resistance to sudden movements, rather than the stark resistance of conventional flooring which often results in sprained ankles and other injuries.

Accordingly, the present invention offers a surprising and unexpected duality of benefits wherein a flat flooring is provided with maximum traction, yet wherein the flooring has vertical impact resistance associated with grid supported plastic tiles. In addition, vertical impact is further reduced by the absorption of lateral forces into adjacent tile structure. In short, the development of a tile capable of lying flat, despite contrary experience for such tile prepared in the prior art, is supplemented with physiological advantages for persons using this flooring by reducing impact damage to ankles, knees and other tissue which is frequently torn or stressed by lack of tolerance or give within the flooring structure utilized.

Specific compositions applied to the tiles fabricated in accordance with the present invention include low density polyethylenes and polypropylene copolymers. Other compositions of similar modulus will be known to those skilled in the art for acceptable substitution.

In addition to the other advantages previously set forth, the present flat surfaced tile offers all of the conveniences of a modular tile structure, including capability for individual replacement of single tiles, inexpensive construction in view of concrete or other acceptable subsurfacing, and similar advantages well known to those skilled in the art.

It is to be understood that the previous disclosure is given by way of example, and is not to be considered limiting except in accordance with the following claims.

I claim:

1. An array of interlocked modular tiles forming a floor covering which provides enhanced traction at its playing surface and improved tolerance to sudden lateral movement, each of said interlocked tiles comprising:

a plastic support grid having a rectangular configuration bounded by a perimeter wall on four sides and including a repeating pattern of intersecting cross members of common corresponding dimensions integrally formed and extending inward from the perimeter wall and joined at cross junctions along a common plane with interstitial openings formed therebetween;

a plurality of support legs of common length integrally coupled to a base side of the cross junctions in general perpendicular orientation with respect to the support grid;

interlock means coupled to and extending outward from the perimeter wall to enable removable attachment of additional modular tiles of similar design at corresponding edges thereof;

said interlock means being coupled to interlock means of each adjacent tile in the array and providing a continuous, uniform displacement gap between adjacent perimeter walls, said gap providing a static separation distance within the range of 0.5 to 2.0 mm, said separation distance being established by a biased position on the interlocking means which yields in response to lateral forces imposed at the tile along a perpendicular orientation with respect to the attached perimeter wall to collapse or extend the gap and thereby absorb the lateral forces, said interlock means providing a restoration force to return to the biased position and desired gap range; and a continuous sheet of plastic integrally formed in uniform thickness with a top edge of the support grid to provide a flat surface cap bounded at its edges by the perimeter walls of the tile.

2. A tile as defined in claim 1, wherein the separation distance between the respective perimeter walls is approximately 1 mm and the amount of yield in the interlock means permits collapse or extension to displace a perimeter wall at least 1 mm.

3. A tile as defined in claim 1, wherein the uniform thickness of the surface cap is at least 1.5 mm.

4. A tile as defined in claim 1, wherein the uniform thickness of the surface cap is approximately 2 mm.

5. A floor surface comprising the array of tiles as defined in claim 1, wherein each of the respective tiles is interlocked as part of the floor surface and biased with a separation distance between perimeter walls within the range of 0.5 mm to 1.5 mm, said interlock means providing a biased position which permits several tiles along any direction of force to cumulate displacement of more than one tile to thereby cushion abrupt lateral forces applied to the floor surface by an athlete by allowing tile displacement to exceed the amount of yield provided by any single interlock means.

6. A tile as defined in claim 1, wherein the plastic comprises linear low density polyethylene.

7. A tile as defined in claim 1, wherein the plastic comprises a polypropylene copolymer.

* * * * *